US005619240A

United States Patent [19]

Pong et al.

[11] Patent Number: 5,619,240

[45] Date of Patent: Apr. 8, 1997

[54] PRINTER MEDIA PATH SENSING APPARATUS

[75] Inventors: William Y. Pong, Tualatin; Richard G. Chambers, Portland; James D. Rise, Lake Oswego, all of Oreg.

[73] Assignee: Tektronix, Inc., Wilsonville, Oreg.

[21] Appl. No.: 382,460

[22] Filed: Jan. 31, 1995

[51] Int. Cl.[6] ..... B41J 2/385; G03G 9/08

[52] U.S. Cl. ..... 347/103; 347/4; 347/154

[58] Field of Search ..... 347/88, 102, 103, 347/213, 154, 4; 355/206, 207

[56] References Cited

U.S. PATENT DOCUMENTS

| | | | |
|---|---|---|---|
| 4,275,968 | 6/1981 | Irwin | 347/104 |
| 4,477,178 | 10/1984 | Furuichi et al. | 355/206 |
| 4,536,079 | 8/1985 | Lippolis et al. | 355/206 |
| 4,553,830 | 11/1985 | Nguyen | 355/206 |
| 4,613,877 | 9/1986 | Spencer et al. | 347/133 |
| 5,042,790 | 8/1991 | Miller et al. | 271/110 |
| 5,142,340 | 8/1992 | Farrell et al. | 355/283 |
| 5,164,770 | 11/1992 | Furuichi et al. | 355/206 |
| 5,237,378 | 8/1993 | McEwen | 355/309 |
| 5,266,966 | 11/1993 | Fushimi et al. | 347/220 |
| 5,287,123 | 2/1994 | Medin et al. | 347/102 |
| 5,337,258 | 8/1994 | Dennis | 364/551.01 |
| 5,372,852 | 12/1992 | Titterington et al. | 347/103 |
| 5,406,321 | 4/1995 | Schwiebert et al. | 347/102 |

*Primary Examiner*—Benjamin R. Fuller
*Assistant Examiner*—Raquel Yvette Gordon
*Attorney, Agent, or Firm*—Ralph D'Alessandro

[57] ABSTRACT

A media sensing system monitors the movement of media along the media pathway (76) as a sheet of printing medium (56) is transported through the printer 50. The media sensing system permits a hand fed sheet of printing medium (56) to be detected by a sensor (302) and signal to be sent to inactivate a print media pick roller (122) that automatically feeds print media. The sensing system senses the transport of print media (56) by print media transport rollers (140, 142) detecting media sheet size, activates the transfer process of an image from the liquid intermediate transfer surface on the transfer drum (54) to a sheet of print medium (56) after pausing the sheet of print medium to synchronize its movement along the media pathway with the imaging process, and activating the preheater (60) to heat the print medium (56) prior to image transfer and fusing. The sensing system senses the exit of the print medium (56) from the media exit rollers (212, 220) for delivery to an output tray (68).

13 Claims, 10 Drawing Sheets

PRINTER MEDIA PATH SENSING APPARATUS

TECHNICAL FIELD

This invention relates to ink-jet printers and more particularly to a media sensing system that senses the location of the sheet of image-receiving medium during a printing process which includes the steps of print head tilt, media picking, media transport, transfer roller loading, media stripper finger engagement, exit gear train engagement, and drum maintenance functions.

BACKGROUND OF THE INVENTION

There are known apparatus and methods for sensing the presence of media in printers along the media pathway during the performance of key operations within a printer. However, the inclusion of multiple functions within a printer occurring in rapid succession requires the use of multiple and reliable sensors to detect the presence of the sheet of print medium and to permit the continued operation of the printer.

Printers and copiers for some time have routinely employed sensors to detect the presence or absence of media to signal the operator to replenish the supply of media. However, as technologies have advanced and printing speeds have increased it has become necessary to detect more conditions more rapidly to ensure safe and efficient operation of the desk top printers now widely used in conjunction with personal computers. For example, in phase change ink printers one of the key functions involves the fusing of the ink image to the image-receiving medium. This function requires the proper timing of the feeding of the medium into a media preheater and the completion of the imaging process on a transfer drum followed by the movement of a fusing roller, such as by actuation of an eccentric shaft, to move the fusing roller against the transfer drum, thereby forming a pressure nip through which the medium is fed, to ensure that the image is both pressure and heat fused to the image receiving medium. Sensors are required to ensure that these functions are coordinated and timely initiated. Sensors can also be required to check for jams that may occur by signalling the passage or non-passage of media past specific points along the media flow path within the printer. Such sensors can be coupled to visual or audial indicators in order to alert the printer operator to media path malfunctions.

Printers, copiers, and facsimile machines are other examples of mechanically complex devices that perform multiple print producing functions. FIG. 1 shows an exemplary transfer printer 10, which is described in U.S. Pat. No. 4,538,156 issued Aug. 27, 1985 for an INK JET PRINTER. A multiple-orifice ink-jet print head 12 deposits an ink image on a surface 14 of a transfer drum 16 that is rotated by a motor (not shown) driving a drum shaft 18. A print medium 20 received from a media supply tray 22 is advanced into a nip formed between transfer drum 16 and a transfer roller 24. A solenoid 26 is energized actuating a linkage 28 that pivots an arm 30 holding transfer roller 24 such that print medium 20 is pressed in the nip between transfer drum 16 and transfer roller 24. The rotation of drum 16 draws print medium 20 through the nip, thereby transferring the ink image from drum surface 14 to print medium 20 while feeding it into an exit path 32. After print medium 20 leaves the nip, solenoid 26 is de-energized and a solenoid 34 is energized, pivoting an arm 36 holding a web roller 38 such that a drum cleaning web 40 is drawn into contact with and cleans surface 14 of transfer drum 16. The rotation of transfer drum 16 draws cleaning web 40 from a web supply spool 42 to a web take-up spool 44. After transfer drum 16 is adequately cleaned, solenoid 34 is de-energized and the above-described process may be repeated.

In practice, such printers may also include print processing functions not shown in FIG. 1, such as a print media picking function that picks a single sheet of print medium 20 from media supply tray 22, a print media transport function that transfers print medium 20 into the nip, a stripper finger engagement function that strips print medium 20 off transfer drum 16, an exit path engagement function that drives print medium 20 into exit path 32, a web take-up spool 44 driving function that provides a fresh supply of drum cleaning web 40, and a print head positioning function that provides adequate clearance between transfer drum 16 and print head 12 for periodic print head maintenance.

The above-described functions are selectively engaged by independent motive forces, actuated in a predetermined timing sequence, and in some cases at a particular angular position of transfer drum 16. Each function has a "home position" or a rotationally indexed position that must be initialized or sensed prior to each print, following a paper jam, after filling the media supply tray, or when initiating a print head maintenance process. Some functions, such as media feed may be accomplished manually or automatically, requiring interactive and alternative driving mechanisms. As a result, the above-described functions plus other reversible functions such as transfer roller engagement and print head positioning are typically powered and engaged by multiple independent motive forces, the number of which together with their associated linkages and controllers result in an unduly complex and sub-optimal printing mechanism that consumes excessive power and space and can require rapid and effective sensing mechanisms to permit effective and reliable operation.

What is needed, therefore, is a compact multiple function print processor in which the functions are monitored and controlled by a simple and effective sensor system to form an improved printing mechanism.

SUMMARY OF THE INVENTION

It is an object of this invention to provide an improved sensing system for a multiple function printing apparatus and method.

It is another object of this invention to provide a multiple function printing apparatus and method in which the multiple functions are sensed by interactive sensing systems.

It is a feature of the present invention to provide a manual media feed mode which is detected and overrides or shuts down the automatic media feed mode.

It is another feature of the present invention to provide a multiple function printing sensing system that controls the synchronization of the feeding of the print medium into a media preheater with the completion of the imaging process on the transfer drum and the subsequent movement of the fusing roller mechanism to form a pressure nip with the transfer drum to fuse the image to the print medium.

It is still another feature of the present invention to provide a multiple function printing sensing system that the system insures that the media sheets are properly aligned within the printer along the media pathway and shuts down the printer drive train when one sensor in the pathway misses sensing the transport of a sheet of print medium past its sensing field.

It is yet another feature of the present invention to provide a multiple function printing sensing system that detects the size of the print medium moving through the printer along the media flow path.

It is still another feature of the present invention to provide a multiple function printing sensing system that pauses the sheet of print medium prior to advancing it into a media preheater to synchronize the movement of the print medium with the imaging process so that the sheet of print medium arrives at the image transfer point simultaneously with the completion of the imaging process on the intermediate transfer surface to permit the printed image to be transferred to the feed of print medium.

It is an advantage of the present invention that a multiple function printing sensing system is provided that accurately permits operation of the complex printer functions to occur with feedback being provided when malfunctions occur and interactive function control is achieved.

These and other objects, features and advantages are obtained in the printer sensing system of the present invention which reliably detects malfunctions affecting the passage of media along the media flow path in the printer and permits interactive control of sequential functions to be accomplished. Sensors monitor the selective engagement of media transport rollers, the transport of a picked print medium to the proper position to receive an ink image at a nip formed between the loaded transfer roller and the transfer drum, the synchronization of the feeding of a sheet of print medium into the media preheater and the completion of the imaging process on the transfer drum, and the stripping of the printed print medium from the transfer drum by stripper finger mechanism and its direction into media exit rollers for delivery to a media output tray.

BRIEF DESCRIPTION OF THE DRAWINGS

These and other objects, features and advantages of this invention will become apparent upon consideration of the following detailed disclosure of a preferred embodiment of the invention, especially when it is taken in conjunction with the accompanying drawings wherein.

DETAILED DESCRIPTION OF A PREFERRED EMBODIMENT

Figure 7:
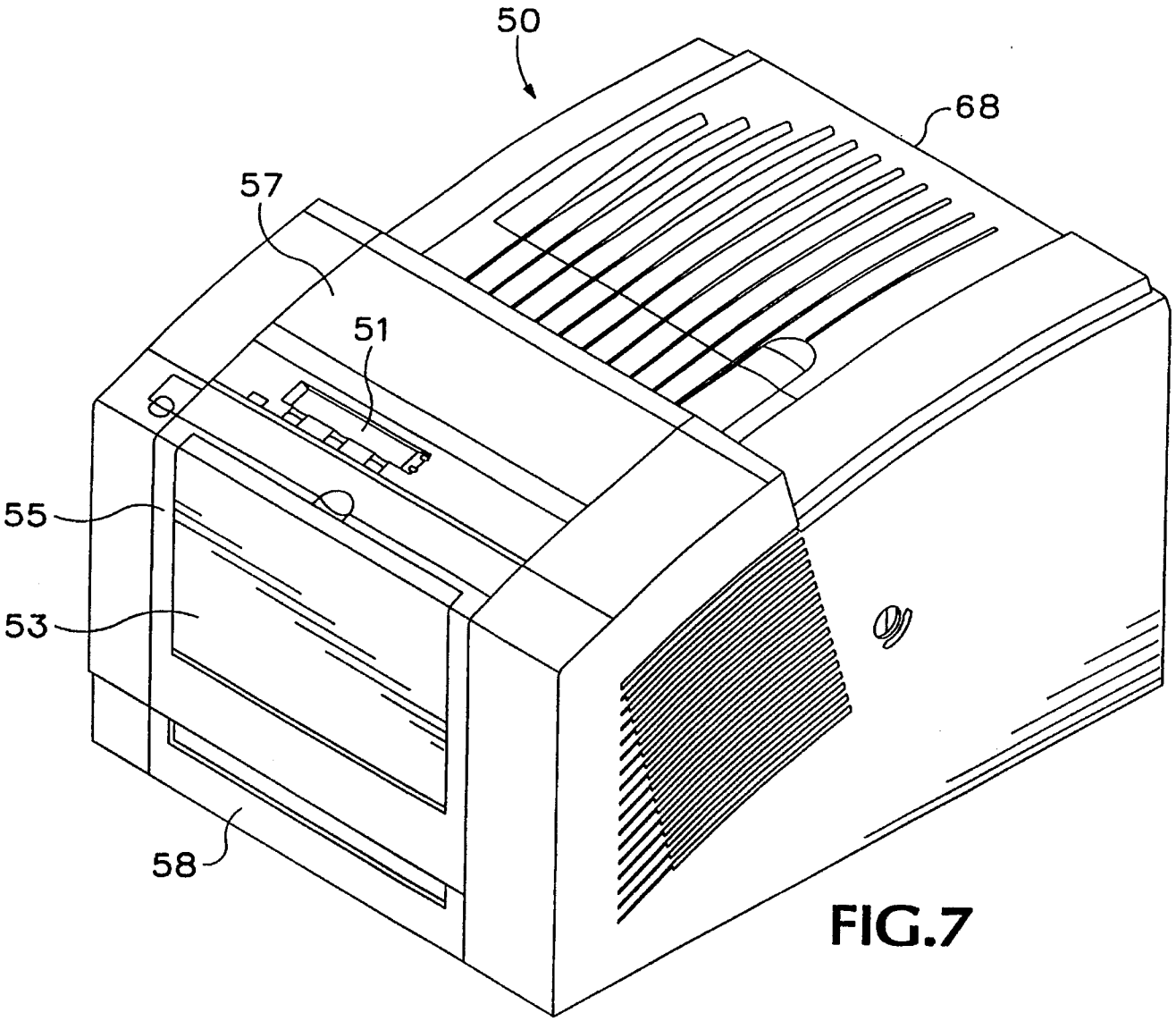
FIG. 7 is perspective view of a printer employing the sensing system and drive train mechanism of the present invention.

FIG. 7 shows in side perspective view the ink jet image transfer printer 50 with hand feed access door 53, front panel door 55, media tray access panel 14, media output tray 68 and operator display panel 51. The display panel 51 permits an LED or other appropriate display medium to display messages to the operator during operation of the printer 50, such as when a media jam occurs or the ink supply needs to be replenished.

Figure 1:
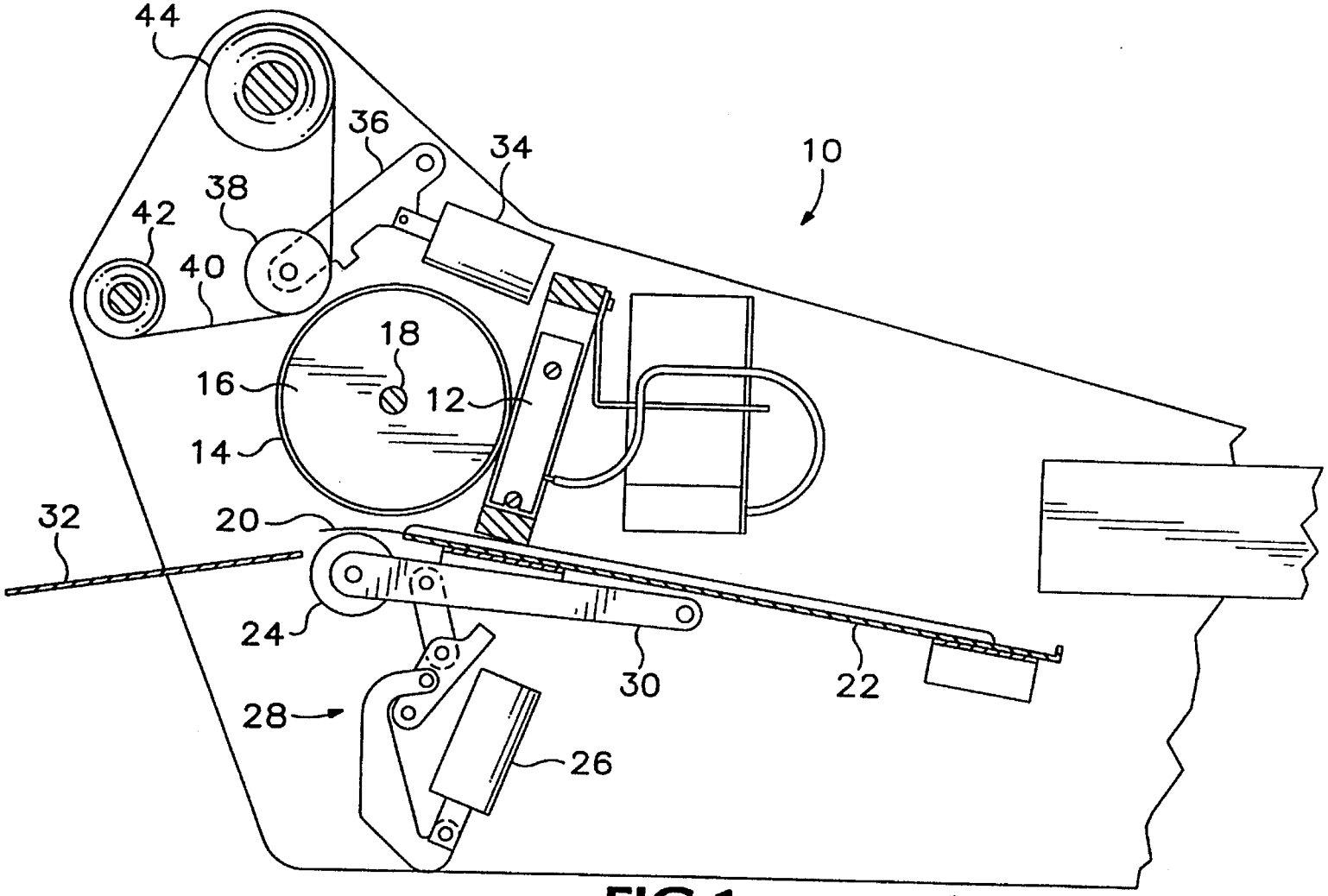
FIG.1 (PRIOR ART)
FIG. 1 is a simplified left side elevational view showing print processing mechanisms of a prior art ink-jet image transfer printer.
Figure 2:
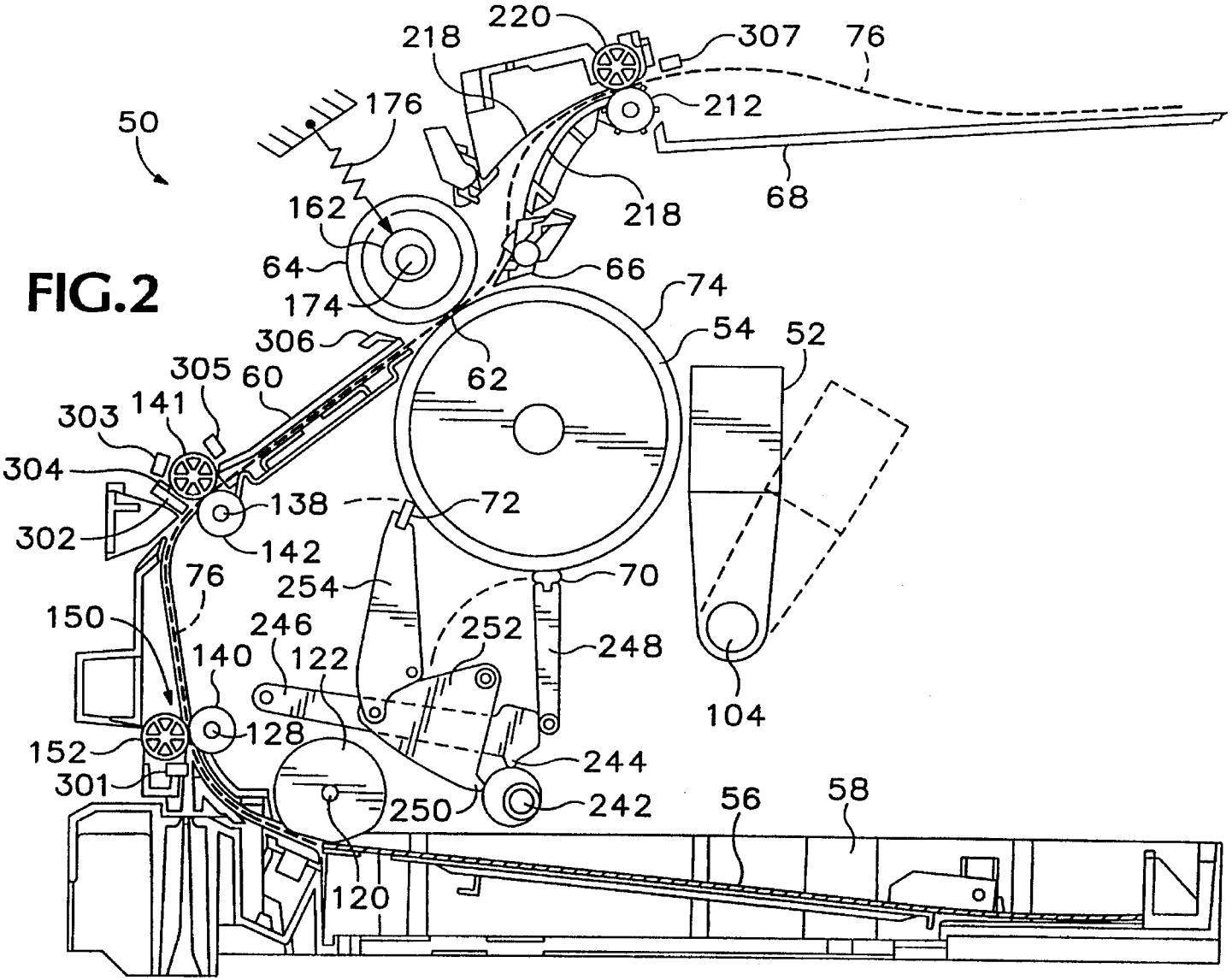
FIG. 2 is a simplified right side elevational view showing print processing mechanisms of an ink-jet image transfer printer employing this invention.

Referring to FIG. 2, print processing functions performed by an ink jet image transfer printer 50, best seen in FIG. 7, hereinafter "printer 50") employing this invention include: a print head tilt function that provides clearance between a print head 52 and a transfer drum 54 for periodic print head maintenance; a print media picking function that picks a print medium 56 from a media supply tray 58; a print media transport function that transports the picked print medium 56 from media supply tray 58, through a media preheater 60, and into a transfer printing process; a transfer roller loading function that forms a nip 62 between a transfer roller 64 and transfer drum 54 to engage the transfer printing process; a print media stripping function that engages stripper fingers 66 to strip the printed print medium 56 off transfer drum 54; an exit path function that receives the printed print medium 56 from stripper fingers 66 and directs it through an exit path into a media output tray 68; and a transfer drum maintenance function that sequentially engages with transfer drum 54 a fluid carrying wick 70 and a blade 72 that condition transfer surface 74 of transfer drum 54 for receiving an ink image. Print medium 56 follows a media pathway 76 (shown in dashed lines) through printer 50.

The print head tilt function is described in co-pending U.S. Pat. application Ser. No. 08/300,020 filed Sep. 2, 1994 for PRINTER PRINT HEAD POSITIONING APPARATUS AND METHOD, which is assigned to the assignee of this application and incorporated by reference in pertinent part hereinafter. The print head tilt function and the transfer roller loading function are the only two functions in the media drive train in printer 50 that employ bidirectional rotation of their respective actuating shafts. A one-way clutch, described with reference to FIGS. 3 and 4, mechanically protects the remaining functions from potentially destructive bidirectional rotation.

Figure 3:
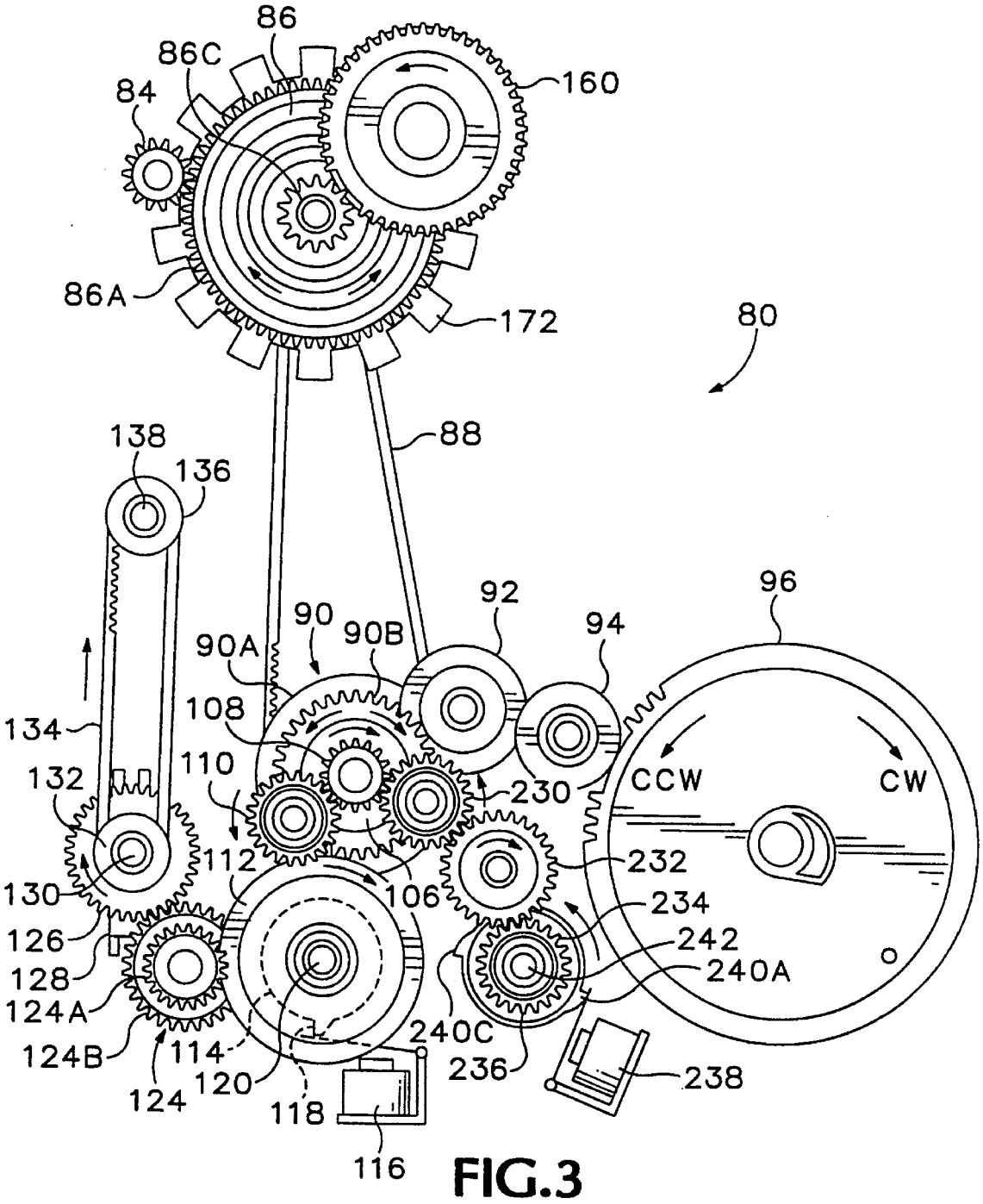
FIG. 3 is a right side view showing the mechanical interrelationships existing among the gears, belts, clutches, and encoders of a drive train that provides motive force for operating the print processing mechanisms of FIG. 2.
Figure 4:
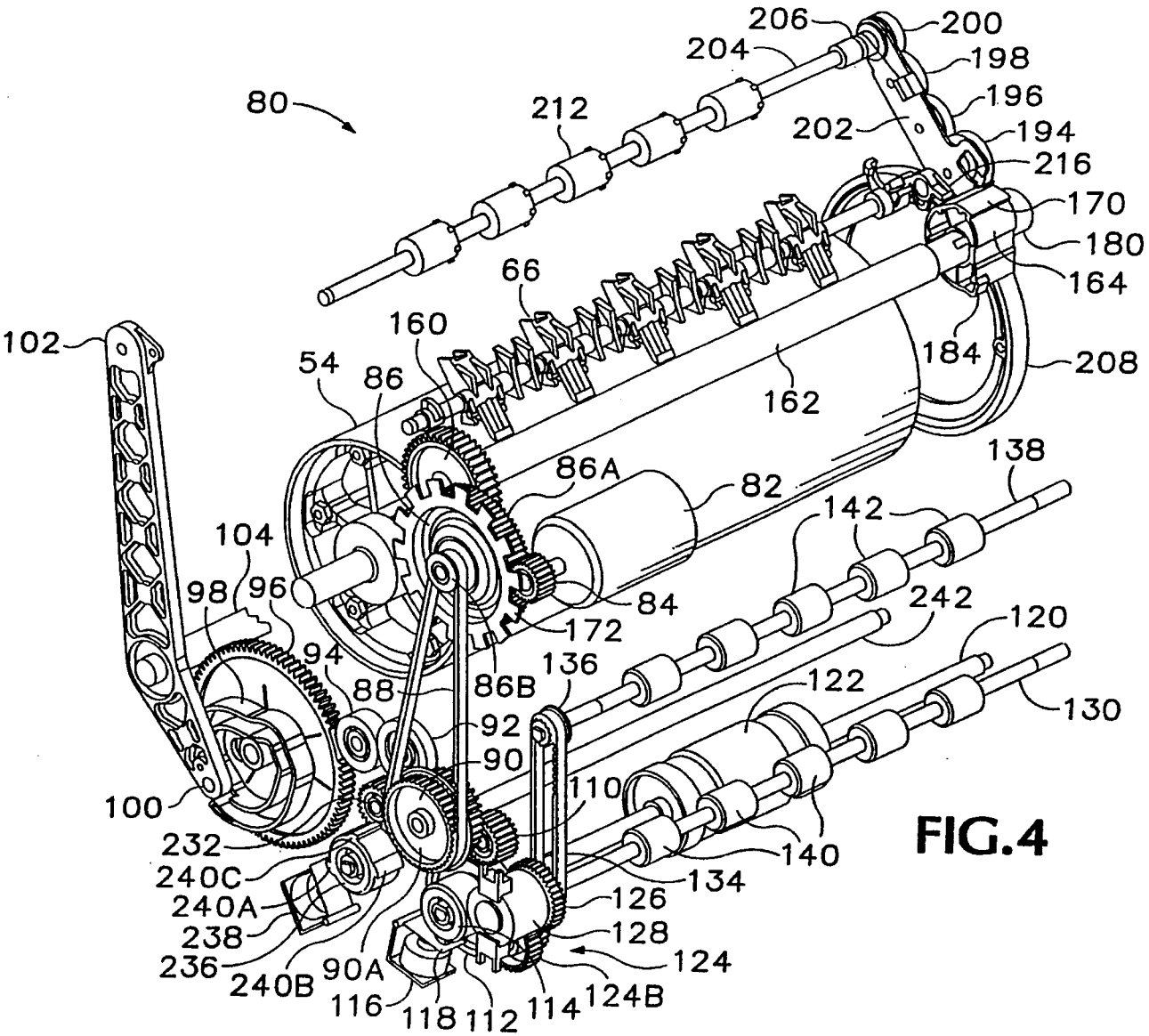
FIG. 4 is a left side isometric view showing the spacial interrelationships existing among a tilt cam, tilt arm, media pick roller, media transfer rollers, eccentric shaft, transfer drum, latch cam, stripper fingers, and exit rollers driven by the drive train of FIG. 3.

FIGS. 3 and 4 show a drive train 80 in which a single process motor 82 provides the motive force to operate the above-described functions.

Regarding the print head tilt function, process motor 82 bidirectionally drives an 18-tooth, 32-pitch drive gear 84 that is meshed with a 72-tooth, 32-pitch gear 86A on a compound gear 86. A 14-tooth, 3-millimeter-pitch pulley 86B on compound gear 86 is coupled by a drive belt 88 to a 42-tooth, 3-millimeter-pitch pulley 90A on a compound gear 90. A 32-tooth, 24-pitch gear 90B on compound gear 90 bidirectionally drives a 24-tooth, 24-pitch idler gear 92, which in turn drives a 20-tooth, 24-pitch idler gear 94. An 80-tooth, 24-pitch missing tooth gear 96 is rotationally biased in a counter-clockwise ("CCW") direction, but held in the disengaged ("home") position (shown in FIGS. 3 and 4) by a clapper solenoid (not shown).

When the clapper solenoid is engaged, missing tooth gear 96 rotates CCW to mesh with idler gear 94, which subsequently controls the rotation of missing tooth gear 96 through the above-described portion of drive train 80. Missing tooth gear 96 allows for CCW and clockwise ("CW") rotation of a scroll cam in which a cam follower 100 rides to pivot a tilt arm 102 about a print head positioning shaft 104.

Referring again to FIG. 2, print head 52 is shown rotated about print head positioning shaft 104 in a printing tilt orientation in solid lines and in a maintenance tilt orientation in dashed lines. Both orientations, and those in-between, are controlled by meshing missing tooth gear 96 with idler gear 94 and causing process motor 82 to rotate by predetermined amounts in the CCW and CW directions. The print head tilt function disengages at the home position when the clapper solenoid is engaged, and the missing tooth portion of missing tooth gear 96 disengages from idler gear 94.

Regarding the print media picking function, FIGS. 3 and 4 show a one-way clutch 106 attached to compound gear 90 such that only CW rotation is transmitted to a 15-tooth, 32-pitch gear 108, which in turn meshes with a 24-tooth, 32-pitch idler gear 110 that meshes with a 54-tooth, 32-pitch gear 112, which is attached to a single-pole spring-wrap clutch 114. A spring-wrap clutch is a well-known device that prevents the transmission of rotational torque from an input gear to an output shaft when a housing surrounding the clutch is constrained from rotating, but which transmits the rotational torque when not constrained. Spring-wrap clutch 114 is constrained in its home position (shown in FIG. 4) by a clapper solenoid 116, that when de-energized, abuts a stop 118. When the clapper solenoid is briefly energized, it disengages from stop 118, allowing spring-wrap clutch 114 to transmit one CW rotation of gear 112 to a shaft 120 before clapper solenoid 116 again abuts stop 118. The single rotation of shaft 120 is transmitted to a pick roller 122 that picks a single sheet of print medium 56 from media supply tray 58 (FIG. 2). Stop 118 on spring-wrap clutch 114 establishes the home position for pick roller 122.

Regarding the print media transport function, gear 112 meshes with a 20-tooth, 32-pitch gear 124A that co-rotates with a 32-tooth, 32-pitch gear 124B, which together form a compound gear 124. Gear 124B meshes with a 36-tooth, 32-pitch transport drive gear 126, rotation of which is selectively transmitted by an electro-mechanical clutch 128 to a lower transport shaft 130. A 14-tooth, 3-millimeter-pitch pulley 132 transmits the rotation of lower transport shaft 130 via a 63-tooth, 3-millimeter-pitch belt 134 to a 14-tooth, 3-millimeter-pitch pulley 136 that drives an upper transport shaft 138. Transport shafts 130 and 138 are, thereby, linked together to co-rotate respective transport rollers 140 and 142 when electro-mechanical clutch 128 is energized.

Referring to FIG. 2, electro-mechanical clutch 128 allows timing the start of the media transport function relative to the media picking function such that picked print medium 56 moves from media supply tray 58 into a rolling nip 150 formed between transport roller 140 and an idler roller 152 for transport into media preheater 60 and nip 62.

Alternatively, the energizing of electro-mechanical clutch 128 may be timed such that picked print medium 56 is fed into a stationary nip 150 to accomplish a print media "deskewing" function. Media deskewing is commonly accomplished by butting the leading edge of a print medium into a stationary nip to buckle the print medium, which is subsequently straightened when the nip begins rolling.

Regarding the transfer printing process, a comprehensive description thereof is found in co-pending U.S. Pat. application Ser. No. 08/255,585 filed Jun. 8, 1994 for METHOD AND APPARATUS FOR CONTROLLING PHASE-CHANGE INK-JET PRINT QUALITY FACTORS, which is assigned to the assignee of this application and is specifically incorporated herein by reference in pertinent part.

Regarding the transfer roller loading function, FIGS. 3 and 4 show that compound gear 86 also includes a 14-tooth, 24-pitch gear 86C that is normally disengaged in the missing tooth portion of a 42-tooth, 24-pitch missing tooth gear 160. Missing tooth gear 160 is attached to one end of an eccentric shaft 162, which has a latch cam 164 attached to the opposite end thereof.

Figure 5:
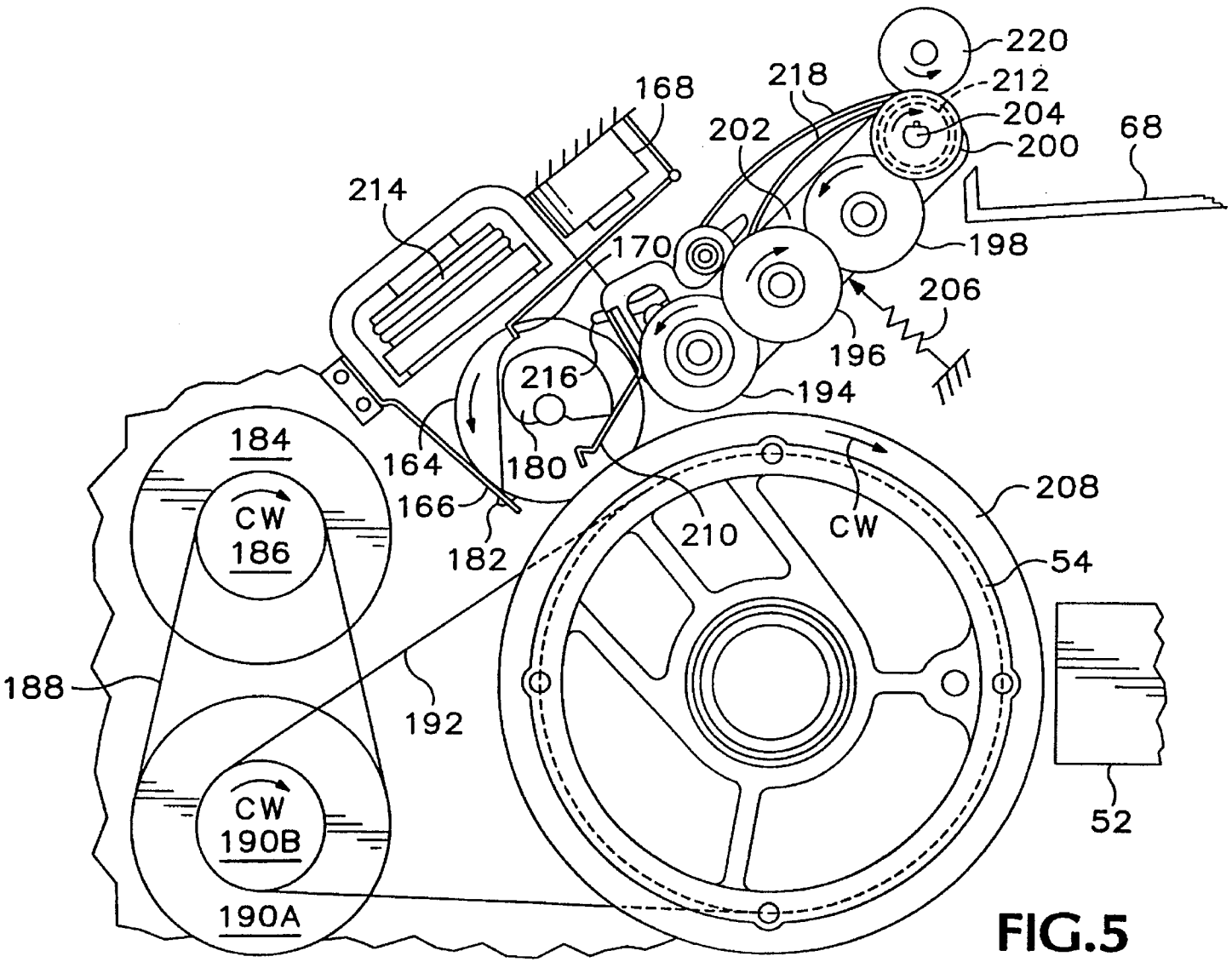
FIG. 5 is a right side view of a latch cam driven media exit path mechanism shown with the latch cam in a latched position in which the exit path mechanism is disengaged from an image transfer drum ring gear.

Referring also to FIG. 5, latch cam 164 is rotationally biased CCW by a leaf spring 166 and is held in a home position by a clapper solenoid 168 that abuts a stop 170 on latch cam 164. When clapper solenoid 168 is energized it disengages from stop 170 allowing missing tooth gear 160 to rotate CCW into engagement with gear 86C. A 14 slot encoder 172 coupled to 14-tooth gear 86C is employed to cause gear 86C to rotate into and stop at any one of 14 rotational positions that ensure proper meshing of gear 86C with missing tooth gear 160 when clapper solenoid 168 is energized.

When the media transport function delivers the leading edge of print medium 56 into nip 62, clapper solenoid 168 is energized to start the transfer roller loading function by meshing missing tooth gear 160 with gear 86C as described above. Process motor 82 is activated and transfers its motive force through gears 84, 86A, 86C, and 160 to rotate eccentric shaft 162 in the CCW direction. Eccentric shaft 162 has a 0.031-inch eccentricity, such that rotating it imparts a simple harmonic displacement to an axial shaft 174 (FIG. 2) about which transfer roller 64 freely rotates. Therefore, when eccentric shaft 162 is in its home (latched or zero-degree) position, a 0.062-inch clearance exists between transfer roller 64 and transfer drum surface 74. When eccentric shaft 162 is rotated to a 180-degree, bottom dead center position, a 600- to 800-pound spring force 176 stored in a load frame is transferred to nip 62. The full spring force is substantially transferred when eccentric shaft 162 is rotated in a range of angles between about 163 degrees and about 191 degrees such that eccentric shaft 162 may be rotated significantly around bottom dead center without significantly changing the force in nip 62.

Continued CCW rotation of eccentric shaft 162 removes spring force 176 from transfer roller 64, restores clearance in nip 62, returns eccentric shaft 162 to its home (latched) position, and completes the roller loading function.

Figure 6:
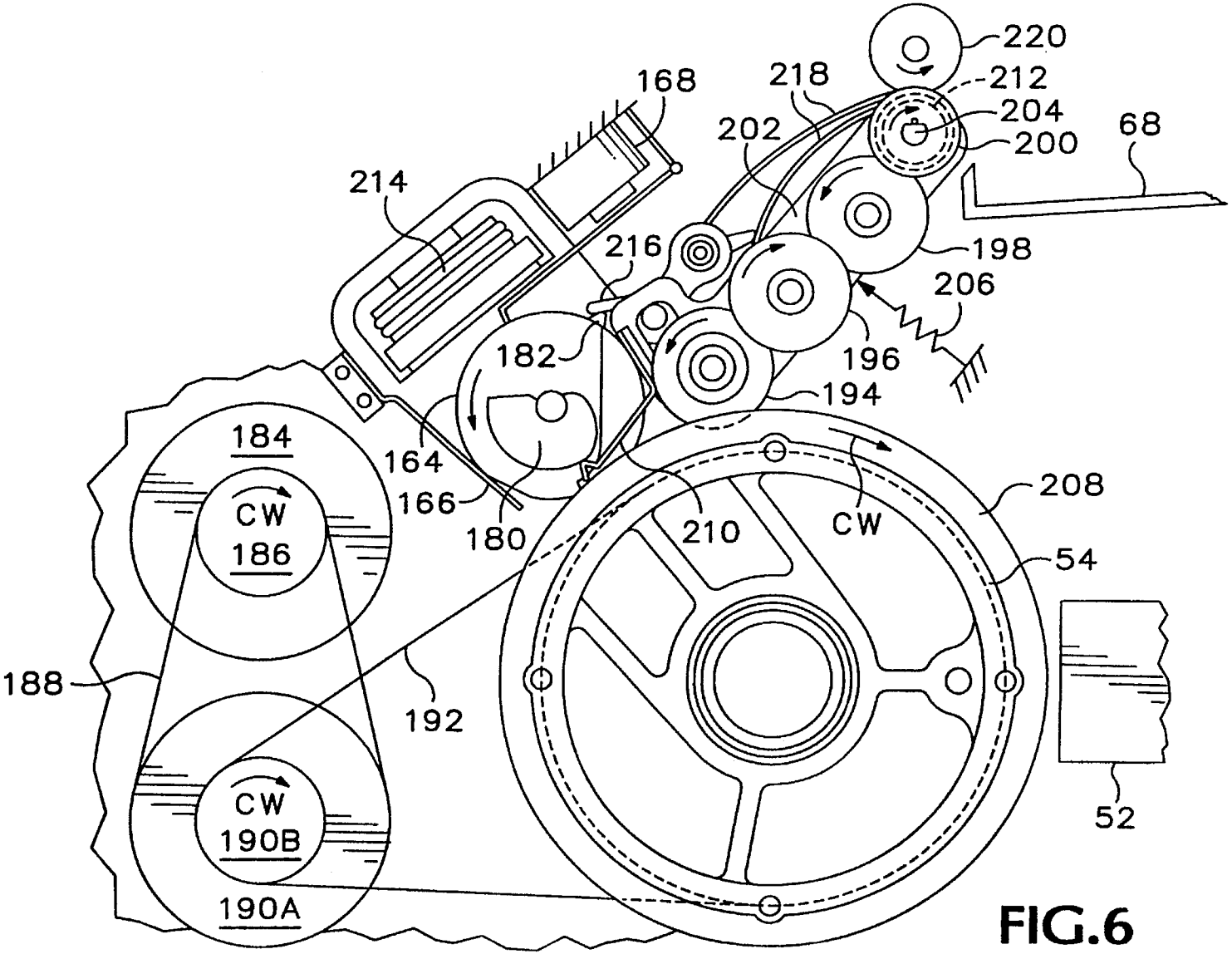
FIG. 6 is a right side view of the latch cam driven media exit path mechanism of FIG. 5, shown with the latch cam in a 180 degree rotated position in which the exit path mechanism is engaged with the image transfer drum ring gear.

Regarding the print media stripping and exit path functions, FIGS. 4–6 shows latch cam 164 further including an exit gear engagement cam 180 and a stripper finger actuating lobe 182 that are positioned on axially opposite sides of latch cam 164. The print media stripping and exit path functions are actuated in cooperation with the above-described roller loading function to perform the transfer printing process as follows.

A servo-controlled drum drive motor 184 CW rotates a pulley 186 that is coupled by a belt 188 to a compound idler pulley 190A which co-rotates with a compound idler pulley 190B. A belt 192 CW rotates transfer drum 54. Transfer drum 54 is rotated at a precisely controlled rate while receiving a high-resolution ink image from print head 52 to ensure that the ink image is properly registered. This requires that all undesirable mechanical loads, such as transfer roller 64, stripper fingers 66, and others are disengaged from transfer drum 54 while it receives the ink image.

Referring to FIG. 5, the above-described roller loading function is started by energizing clapper solenoid 168 after transfer drum 54 receives the ink image. Latch cam 164 is shown at the home, zero-degree position.

An exit gear train including gears 194, 196, 198, and 200 is mounted to an arm 202 that pivots on a shaft 204 to which gear 200 is attached. Arm 202 is biased away from transfer drum 54 by a spring 206 such that gear 194 is normally disengaged from a 100-tooth, 24-pitch ring gear 208 surrounding the periphery of one end of transfer drum 54. Referring also to FIG. 6, as latch cam 164 rotates CCW about 45 degrees, an exit path engagement spring 210 riding on exit gear engagement cam 180 causes arm 202 to pivot gear 194 into engagement with ring gear 208. Gear 194 is a 17-tooth, 24-pitch gear that together with gears 196, 198, and 200 cause shaft 204 to rotate a media exit roller 212 at a tangential rotational speed that is synchronized with the surface speed of transfer drum 54.

As latch cam 164 rotates through about 82 to about 109 degrees, eccentric shaft 162 (FIG. 2) causes transfer roller 64 to begin contacting transfer drum 54. The full force 176 (FIG. 2) of a pair of springs 214 (one shown) is transferred through transfer roller into nip 62 as latch cam 164 rotates through about 163 to about 191 degrees. The image transfer process starts at about 163 degrees at which time the leading edge of print medium 56 is drawn by the rotation of transfer drum 54 through nip 62 into the vicinity of stripper fingers 66. Remember that transfer roller 54 freely rotates on eccentric shaft 162.

As latch cam 164 rotates through about 165 degrees to about 177 degrees (the position shown in FIG. 6), stripper finger actuating lobe 182 trips a lever 216 that causes stripper fingers 66 to contact transfer drum 54, thereby stripping the leading edge of print medium 56 off transfer drum 54 and direct it between a pair of exit guides 218. Stripper fingers 66 are raised as latch cam 164 rotates through about 183 to about 188 degrees.

Transfer drum 54 continues delivering print medium 56 between exit guides 218 until the leading edge of print medium 56 enters a nip formed between media exit roller 212 and an idler roller 220 and is directed into media output tray 68.

The image transfer process is completed by the time latch cam 164 rotates past about 191 degrees, and transfer roller 64 disengages from transfer drum 54 at about 251 degrees to about 278 degrees. By this time print medium 56 has been completely delivered to media output tray 68.

When latch cam 164 rotates through about 300 degrees, the profile of exit gear engagement cam 180 drops, causing arm 202 to pivot away from transfer drum 54, thereby disengaging gear 194 from ring gear 208.

When latch cam 164 rotates to about 360 degrees, missing tooth gear 160 (FIG. 3) disengages from compound gear 86C, clapper solenoid 168 abuts stop 170, and the transfer printing process is completed. Transfer roller 64, stripper fingers 66, and exit path arm 202 are in their respective home positions.

Regarding the transfer drum maintenance function, FIGS. 3 and 4 show a 24-tooth, 32-pitch idler gear 230 and a 30-tooth, 32-pitch idler gear 232 receiving rotational force from gear 108. Idler gear 232 meshes with a 20-tooth, 32-pitch gear 234 on a three-pole spring-wrap clutch 236. Spring-wrap clutch 236 is constrained in its home position by a clapper solenoid 238, which, when de-energized, abuts one of three stops 240A, 240B, and 240C such that each time clapper solenoid 238 is briefly energized, it disengages from one stop and advances to the next stop, thereby allowing spring-wrap clutch 236 to incrementally transmit rotation of gear 234 to a drum maintenance cam shaft 242. Stop 240A on spring-wrap clutch 236 establishes the home position for drum maintenance cam shaft 242. Because there are three stops, a homing sensor (not shown) detects which one is stop 240A for homing purposes.

Referring also to FIG. 2, stops 240A, 240B, and 240C cause drum maintenance cam shaft 242 (FIG. 2) to rotate sequentially to and stop at respective home, wick-actuating, and blade-actuating positions. In the wick-actuating position established by stop 240B, a cam follower 244 on a lever arm 246 causes a lever arm 248 to swing fluid carrying wick 70 into contact with transfer drum 54.

Suitable liquids that may be employed as the liquid intermediate transfer layer include water, fluorinated oils, glycol, surfactants, mineral oil, silicone oil, functional oils or combinations thereof. Functional oils can include, but are not limited to, mercapto-silicone oils, fluorinated silicone oils and the like. The preferred liquid is silicone oil. The thickness of the liquid intermediate transfer layer forming the transfer surface 74 on the transfer drum 54 is theorized to vary from about 0.01 microns to about 50 microns, more preferably from about 0.05 to about 10 microns, and most preferably from about 0.1 to about 1 micron. It is possible to measure the thickness of the layer forming the intermediate transfer surface 74, such as by reflectance Fourier Transform infrared spectroscopy or a laser interferometer. Also, the thickness of the layer forming the intermediate transfer surface 74 can increase if rougher surfaced supporting surfaces or transfer drums 54 are employed. The surface topography of the supporting surface or drum 54 can have a roughness average ($R_a$) of from about 1 microinch to about 100 microinches, and a more preferred range of from about 3 to about 15 microinches. The image quality will degrade when a liquid layer thicker than about 10 microns is used to form the intermediate transfer surface 74.

In the blade-actuating position established by stop 240C, a cam follower 250 on a lever arm 252 causes a lever arm 254 to swing blade 72 into contact with transfer drum 54.

Wick 70 and blade 72 sequentially contact transfer drum 54 such that wick 70 contacts first followed by blade 72. Wick 70 then retracts followed by blade 72. Drum maintenance cam shaft 242 then returns to the home position, thereby completing the transfer drum maintenance function that prepares surface 74 of transfer drum 54 for receiving an ink image.

Referring to FIGS. 2 and 3, drive train 80 solves potentially serious problems encountered when printer 50 looses power, print medium 56 becomes jammed somewhere along media pathway 76, or printer 50 otherwise malfunctions. When any of the above problems occur, the functions of printer 50 must gracefully return to their home positions without damaging any related mechanisms.

FIG. 2 shows the positioning of the sensors that are positioned along the media pathway 76 of the printer 50 of FIG. 7. The sensors track the movement of the sheets of print media 56 from media supply tray 58 through the transport rollers 128 & 142, the nip 62 between the transfer roller 64 and transfer drum 54, and the media exit roller 212 into the media output tray 68.

As seen in FIG. 2, the initial sensor encountered is media pick sensor 301 located just below idler roller 152 to detect the successful picking of media, such as paper or overhead transparency material, from the media supply tray 58. A similar arrangement can be used for an optional auxiliary paper tray situated below media supply tray 58. The sensor 301 is set with a timer so that about 0.97 seconds after the firing of the clapper solenoid 116 of FIG. 4 to start the rotation of the D-shaped pick roller 122, the sensor 301 is set to detect the passage of a sheet of medium 56 past its position. Failure of a sheet of medium 56 to travel past the sensor 301 within the specified time limit will result in a signal being sent to the printer 50 controller. The controller then initiates up to 2 more attempts to pick a sheet of medium 56, resetting the timer clock each time. After the third unsuccessful attempt the controller senses that a jam has occurred and an appropriate signal will be displayed on the front display panel 51 of the printer 50 to indicate that a jam condition exists. If the sheet of print medium 56 passes the sensor 301 within the required time, the printer controller permits the printer 50 operation to continue. Once the sheet of print medium 56 is picked by the pick roller 122, it advances the sheet of medium at a speed of about 5 inches per second (ips) (12.7 cm per second) to the transport roller 140 and idler roller 152. Thereafter the drive gear train moves the sheet of print medium at a speed of about 2 ips (5.08 cm/second) as the medium 56 moves to a staging point at the entrance of the preheater 60.

Sensor 301 typically is a photomicrosensor, as is hand feed sensor 302, such as that commercially available from Omron Electronics, Inc. of Schaumburg, Ill. as model EE-SX 1070 and operates as an opto sensor by having the medium 56 move a plastic flag component which intercepts a beam as the sheet of medium move along the pathway 76.

A front door sensor 303, to detect if front door 55 is closed, is positioned adjacent the idler roller 141 that cooperatively works with transport roller 142. Sensor 303 is a Hall Effect switch, such as that commercially available from Allegro HSG of Worcester, Mass. as model A3141. If front door 55 of FIG. 7 is open, the door's position removes a magnet (not shown) sufficiently far from a Hall Effect sensor and causes a signal to be sent to the printer controller which stops the feed of paper from the media supply tray 58 and all along the media pathway 76 by shutting down power to the transport rollers 140, 138, and 212, transfer roller 64 and transfer drum 54, as well as shutting off the power to the preheater 60.

Two media width sensors 304 (only one of which is shown) are also positioned adjacent idler roller 141 on the media supply tray side to detect the width of the medium 56 travelling along pathway 76. One of the sensors 304 detects A size media and the other detects A4 size media as the medium 56 travels between transport rollers 140 and 142 at a speed of about 2 inches per second (ips) (5.08 cm per second) over a distance of about 3.418 inches (8.69 cm). Time of travel between sensors 301 and 304 is about 2.03 seconds.

Figure 8:
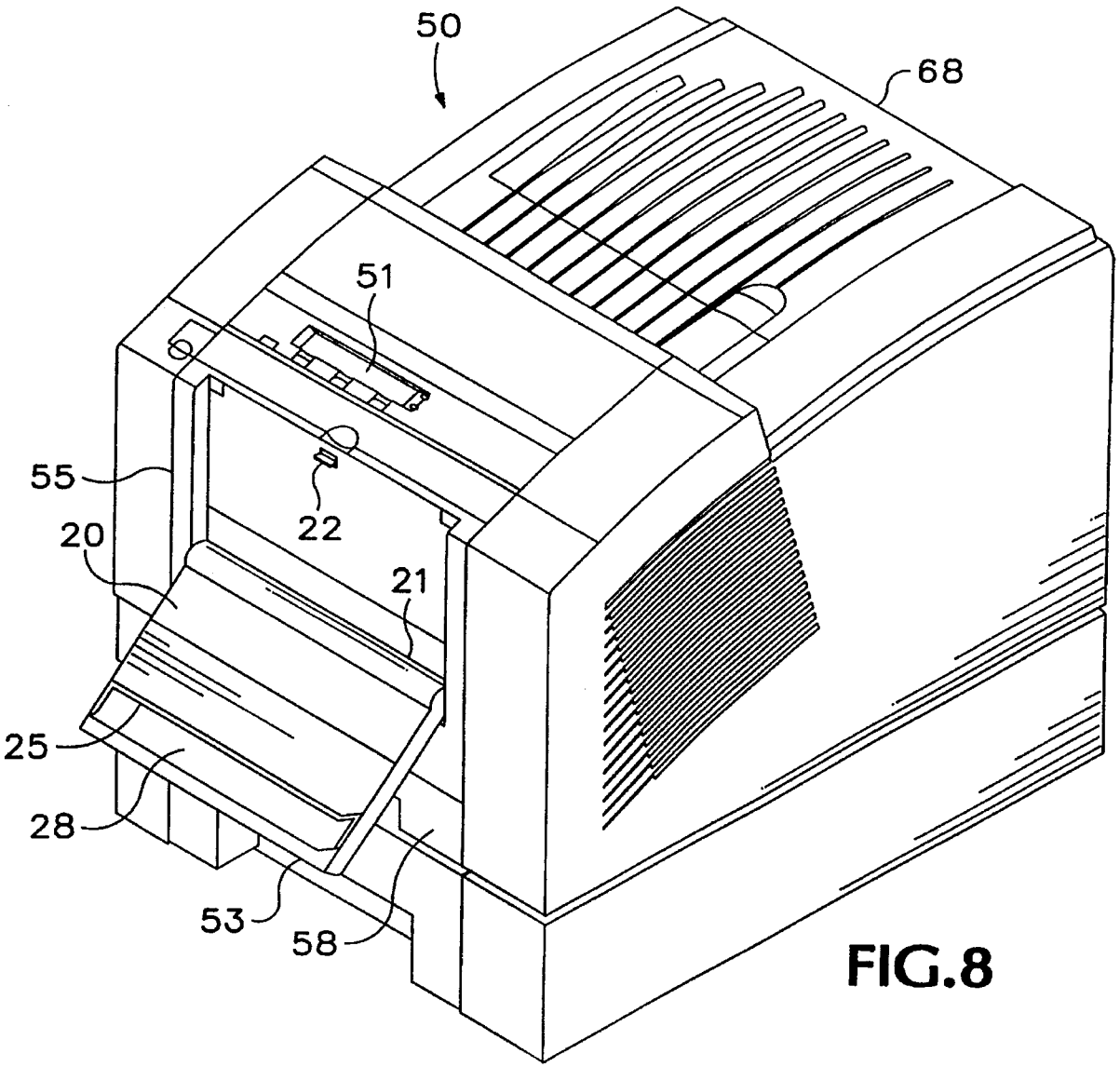
FIG. 8 is a perspective view of a printer with the manual or hand feed print medium tray lowered.

Should a sheet of print medium 56 not be automatically fed from the media supply tray 58, but rather be hand fed by the operator by the lowering of hand feed access door 53 and hand feeding a sheet of print medium 56 into the transport roller 138, hand feed sensor 302 detects the presence of a sheet of medium 56 in the hand feed path by means of a photomicrosensor of the type described above. As best seen in FIG. 8, hand feed access door 53 is hinged about hinge 21 and is lowered by pulling the door 53 out of the latch tab 22 to its lowered position. Door 53 is snapped in into raised position and locked in place by the insertion of the tab 22 into the latch tab receiving opening 23 of FIG. 9. In its lowered position, door 53 has a cover plate 20 that has an opening 25 into which a sheet of print medium 56 is inserted.

Figure 9:
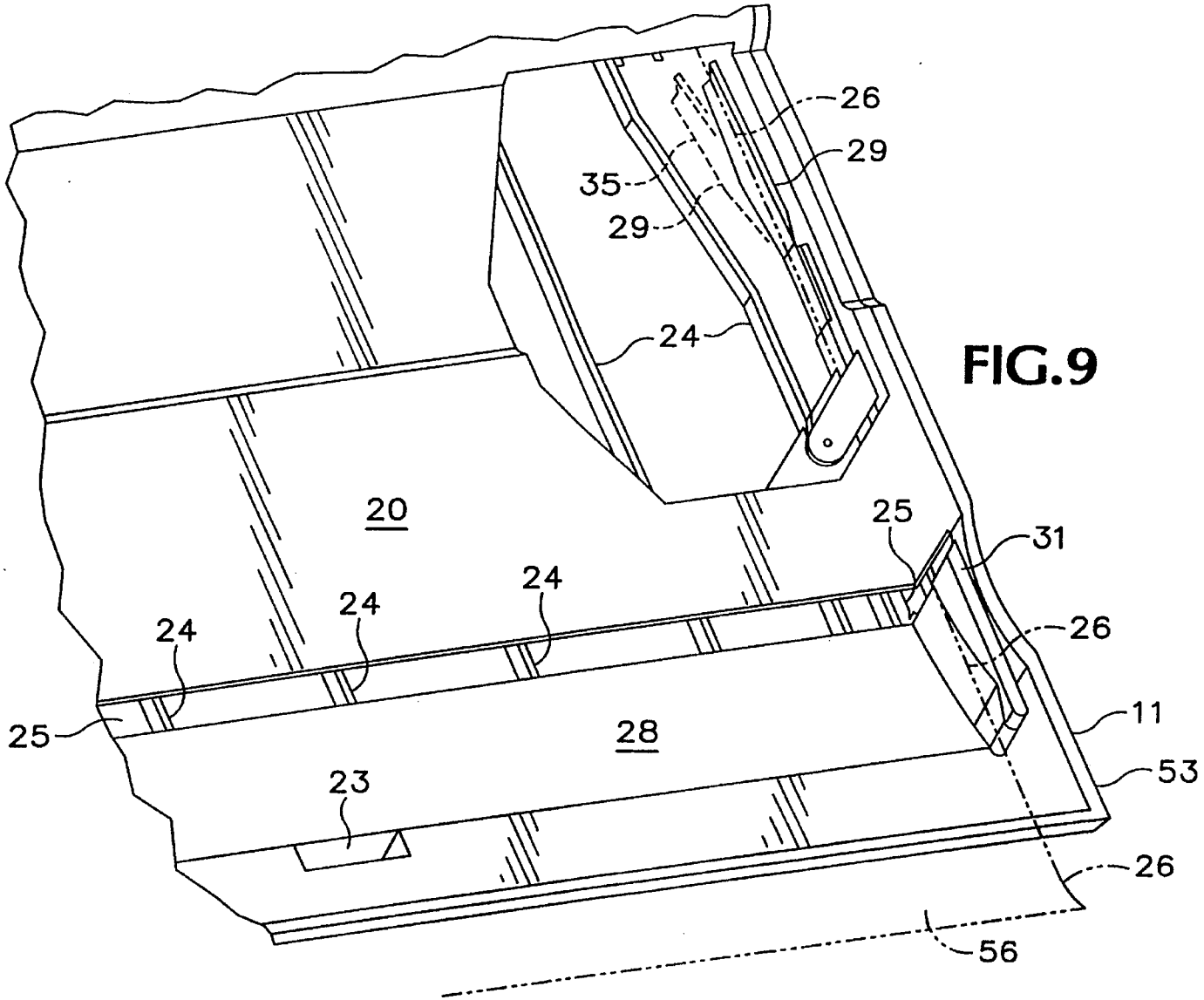
FIG. 9 is a partial perspective view showing the biasing spring that loads or guides the print medium to ensure proper contact with the media width sensors.

FIG. 9 shows a partial perspective view of the hand feed access door 53 in its lowered position with a sheet of print medium 56 being fed along transition ramp 28 into the opening 25. The sheet of print medium 56 is supported by a plurality of media support ribs 24 across the width and length of the bottom of door 53. As seen in FIG. 9, the sheet of print medium 56 has a right side edge 26 that is used to sense the size of the sheet of medium. A spring 29 is shown attached to an adjustable media guide 31, which can be set for either A sized media, shown in solid lines by the numeral 33, or A4 sized media, shown in dotted lines by the numeral 35. The spring 29, shown in solid lines in its compressed state when a sheet of print medium is present and in broken lines in its relaxed position when no medium is present, helps to align the sheet of print medium 56 in the feed path and to pass it through the sensor 302 and into the roller 138 by biasing the sheet of print medium so the left edge is flush with left side of the media insertion opening 25. The spring 29 is strong enough to move the sheet of medium 56 into proper position in the feed path along the inside of cover 53, but is not so strong as to buckle the media. Because the effective range of travel of the spring 29 is limited to about 0.125 inches, it is necessary to reposition the media guide 31 in two distinct positions for either A size (8.5×11 inches or 215.9 mm×279.4 mm) or A4 size (8.268×11.693 inches or 210 mm×297 mm). A positive sensing by the sensor 302 sends a signal to the printer controller indicates that a hand feed is taking place and stops the transmission of power to the paper pick roller 122.

A media preheater entry sensor 305 is located just above the idler roller 141 on the opposing side from the sensors 304 to signal to the printer controller the entrance of the sheet of medium 56 into preheater 60. The medium 56 travels at a speed of about 2 ips (5.08 cm per second) between the pick sensor 301 and the preheater entry sensor 304. The medium 56 travels about 0.75 inches (1.90 cm) as it moves between sensors 304 and 305 with a time of travel of about 150 milliseconds. The sheet of print medium 56 is paused or staged for about 2.5 seconds immediately after passing the preheater entry sensor 305 to synchronize the arrival of the sheet of print medium 56 with the completion of the imaging process on the liquid transfer surface 74 by the print head 52 and being ready to transfer the image to the print medium 56. Once the sheet of medium 56 has entered the preheater 60 it travels a distance of about 3.982 inches (10.11 cm) at a speed of about 5 ips (12.7 cm/second) as the medium 56 moves through the preheater 60 to the preheater exit sensor 306. Sensor 306 keys a time delay to the printer controller to close the nip 62 by rotating the eccentric shaft 162 when the leading edge of the sheet of print medium 56 is detected. The amount of time the sheet of print medium 56 spends in the preheater 60 is thereby standardized or made uniform and therefore any pause time of the sheet of print medium 56 within the preheater 60 minimized. Any pauses where the trailing portion of the sheet of print medium 56 remains in the preheater 60 while the imaging process is completed are limited to about 90 milliseconds until the image transfer and print medium arrival functions are synchronized by the printer controller's timing of the starting of the advance of the sheet of print medium 56 by the transport roller 142.

As the leading edge of the sheet of print medium 56 leaves the preheater 60 it passes through the nip 62 and is driven by the transfer roller 64 and the transfer drum 54 as it travels a distance of about 3.969 inches (10.08 cm) between the nip 62 and the nip between the media exit roller 212 and the idler roller 220 at a speed of about 5 to about 8 inches per second (12.7 to 20.32 cm). When the trailing edge of the print medium 56 is at the nip 62 the transfer roller 64 is disengaged and moves away from the transfer drum 54. The sheet of print medium 56 then is moved at a speed of about 8 ips by the media exit roller 212 and its idler roller 220. The sheet of print medium 56 passes printer exit sensor 307 as it exits the media exit roller 212 into the media exit tray 68.

Sensors 304, 305, and 306 are preferably model EE-SA 104 available commercially from the aforementioned Omron Electronics, Inc. Media exit sensor 307 is preferably a model EE-SX 1041 also available commercially from the same supplier.

Media sheet jams are detected when an expected signal of "paper present" from a sensor takes longer to be received or stays in the sensor longer than the prescribed and preset time. For example, when the preheater entry sensor 305 is tripped the time limit for detection of the sheet of print medium 56 by the preheater exit sensor 306 is set. If this time limit is exceeded, a jam is declared by the printer controller. Should a jam occur with the print medium 56 while it travels along the media pathway 76, the printer controller receives the signal from the appropriate sensor 301, 304, 305, 306, or 307, displays a jam message on the display panel 51 and automatically saves the image data in printer memory. The operator then must manually remove the jammed sheet by opening the appropriate access mechanism, such as removing the media supply tray 58 or opening the door 53 or the access plate 57 of FIG. 7. Once the jammed sheet of print medium 56 is removed, the printer controller automatically sends a cleaning or chaser sheet of print medium 56 through the printer 50 to remove the image from the liquid surface on the drum 54 and the recommencing of the imaging cycle by sending the save image data for imaging again. It is essential that a sheet of print media be aligned properly as it passes into the nip 62 for image transfer since any uncovered area on the transfer surface 74 will result in inked image being placed on the transfer roller 64, causing serious maintenance and operational problems.

Figure 10:
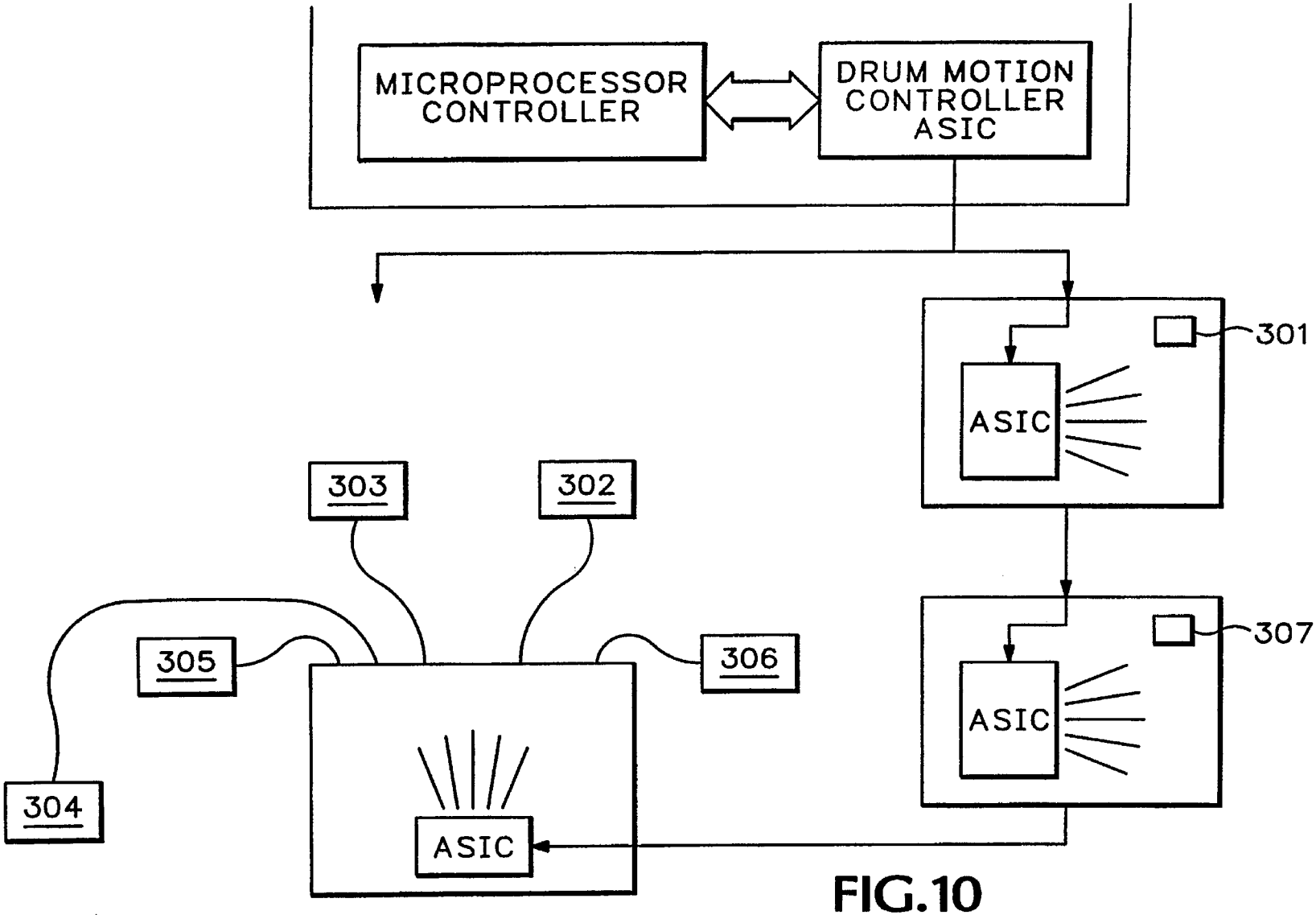
FIG. 10 is a schematic diagram of the sensors and the printer controller.

FIG. 10 shows a diagrammatic illustration of the relationship between the printer processor, the drum motion controller, and the various sensors 301, 302, 303, 304, 305, 306, and 307 in the printer along the media pathway 76. The printer controller is preferably a model 68330 microprocessor controller available commercially from Motorola a company that works in conjunction with a drum motion controller Application Specific Integrated Circuit (ASIC) that is connected by an $I^2C$ bus. An interconnect board links the main microprocessor controller and the drum motion controller sequentially to a three circuit boards to which are connected the three sensors 301, 302, 303, 304, 305, and 306. The media pick sensor 301 is actually located on the first input/output circuit board that is connected to ASIC. The media exit sensor 307 is located on a second input/out circuit board and is also mounted on an ASIC. The remaining sensors are connected via wiring to an ASIC on another input/output circuit board. Each of the ASIC's are repositories for signals sent by the sensors. The printer microprocessor controller continually scans the ASIC's on the individual input/output circuit boards for signals and then activates the transmission of the data upon its request.

To review, the print head tilt and transfer roller loading functions are self-homing by virtue of respective missing tooth gears 96 and 160. The exit path and print media stripping functions are slaved to the self-homing action of the transfer roller loading function. The print media picking and transfer drum maintenance functions are self-homing by virtue of respective spring-wrap clutches 114 and 236, the latter also having a homing sensor. Spring-wrap clutches 114 and 236 are protected from reverse rotation by a one-way clutch 106. The print media transport function has no inherent home position.

Skilled workers will recognize that portions of this invention may have alternative embodiments. For example, many of the functions are applicable to printers other than ink-jet and ink-jet transfer printers and may, therefore, be selectively employed in various combinations. The functions may each implemented in a variety of different ways. For example, drive train gear and belt ratios other than those described may be employed to satisfy particular applications. The media transport function may be implemented with or without a media deskewing function. The transfer roller loading function preferably employs stop-and-drop media timing in which the leading edge of the print medium enters the nip and stops before the transfer roller is loaded, but may accommodate load-on-the-fly media timing in which the leading edge of the print medium enters the nip after the transfer roller is loaded. Of course, particular drive train applications may employ entirely different functions that, never-the-less, employ the principles of this invention.

While the invention has been described above with references to specific embodiments thereof, it is apparent that many changes, modifications, and variations in the materials, arrangement of parts and steps can be made without departing from the inventive concept disclosed herein. For example, it will be appreciated that this invention is also applicable to multi-function drive train applications other than those found in ink-jet printers. Accordingly, the spirit and broad scope of the appended claims is intended to embrace all such changes, modifications and variations that may occur to one of skill in the art upon a reading of the disclosure.

Having thus described the invention, what is claimed is:

1. A media sensing system for a printer applying a printed image by way of an indirect transfer imaging process from an intermediate transfer surface to a print medium of a desired size, comprising in combination:

a print media motive force drive train for transporting media along a media pathway through a printer; and a plurality of sensors positioned along the media pathway for detecting travel of the print medium along the pathway through the printer, the plurality of sensors sequentially detecting the size of the print medium, pausing the print medium for a period of time along the media pathway after the print medium has begun to travel along the media pathway to synchronize movement of the print medium with the imaging process to enable the print medium to receive the printed image from an intermediate transfer surface at an image transfer point, feeding the print medium into a media preheater to heat the print medium prior to and synchronized with the indirect transfer imaging process so that the print medium arrives at an image transfer point simultaneously with completion of the imaging process on the intermediate transfer surface to receive the printed image from an image transfer drum, activating the indirect transfer imaging process from the image transfer drum to the print medium, and detecting exit of the print medium from the printer.

2. The apparatus of claim 1 in which the media sensing system is employed in the image transfer process in which a transfer roller contacts the printed image on the image transfer drum with the print medium.

3. The apparatus of claim 1 in which the media sensing system is in an ink-jet image transfer printer.

4. The apparatus of claim 1 in which the media sensing system detects a hand fed sheet of print medium and inactivates a print medium automatic feed roller that automatically feeds a sheet of print medium into and along the media pathway.

5. The apparatus of claim 4 in which the media sensing system for the hand fed sheet of print medium includes a biasing means for positioning the hand fed sheet of print medium against sensors for detecting the size of the sheet of print medium.

6. The apparatus of claim 1 in which one of the plurality of sensors detects a front access door that is connected to the printer to permit access to the print media pathway being open or closed and if open inactivates the drive train and the media preheater.

7. The apparatus of claim 2 in which the ink jet image transfer printer is a phase change ink jet printer and the media preheater is positioned along the media pathway before the transfer toiler and the image transfer drum.

8. The apparatus of claim 7 in which the ink jet image transfer printer applies a liquid intermediate transfer layer to the image transfer drum to form a transfer surface prior to placing phase change ink on the transfer surface to form the printed image.

9. The apparatus of claim 8 in which the liquid intermediate transfer layer comprises a liquid selected one from the group consisting of water, fluorinated oils, glycol, surfactants, mineral oil, silicone oil, functional oils or combinations thereof.

10. The apparatus of claim 9 in which a clean sheet of print medium is sent through the printer along the media pathway after a media jam occurs and a jammed sheet of print medium is removed from the printer in order to remove a printed image from the intermediate transfer layer before recommencing the imaging process.

11. The apparatus of claim 1 in which each print medium pauses an amount of time before the print medium is fed into the media preheater and a controller varies the mount of time each print medium pauses before the print medium is fed into the media preheater to synchronize the sheet of print medium with the imaging process during each imaging process cycle.

12. A method of printing in a printer using an image transfer surface to create a printed image on a print medium in an indirect transfer imaging process, the printer employing a sensing system in the transfer imaging process comprising the steps of:

a) forming an image on the image transfer surface;

b) feeding a print medium along a media pathway through the printer;

c) pausing the print medium along the media pathway to synchronize the indirect transfer imaging process with the feeding of the print medium;

d) recommencing the feeding of the print medium along the media pathway;

e) feeding the print medium into a medium preheater along the media pathway; and f) transferring the image from the image transfer surface to the print medium to form a printed image.

13. The method of claim 12 further comprising the sensing system detecting a print medium jam and feeding a clean sheet of print medium through the printer to remove the image from the image transfer surface prior to recommencing the imaging process and after removal of a jammed print medium.

* * * * *

UNITED STATES PATENT AND TRADEMARK OFFICE
CERTIFICATE OF CORRECTION

PATENT NO : 5,619,240
DATED : April 8, 1997
INVENTOR(S) : William Y. Pong, Richard G. Chambers, James D. Rise It is certified that error appears in the above-identified patent and that said Letters Patent is hereby corrected as shown below:

Column 13, line 23, delete "toiler" and insert -- roller --;

Column 14, line 6, delete "mount" and insert -- amount --.

Signed and Sealed this

Eighth Day of July, 1997

Bruce Lehman

*Attest:*

BRUCE LEHMAN

*Attesting Officer*

*Commissioner of Patents and Trademarks*